US007665922B2

(12) United States Patent
Rolion et al.

(10) Patent No.: US 7,665,922 B2
(45) Date of Patent: Feb. 23, 2010

(54) WRITING INSTRUMENT

(75) Inventors: Franck Rolion, Asnières-sur-Oise (FR); Arnaud Bez, Garches (FR)

(73) Assignee: Societe BIC, Clichy Cedex (FR)

( * ) Notice: Subject to any disclaimer, the term of this patent is extended or adjusted under 35 U.S.C. 154(b) by 0 days.

(21) Appl. No.: 11/574,933

(22) PCT Filed: Sep. 5, 2005

(86) PCT No.: PCT/FR2005/002203

§ 371 (c)(1),
(2), (4) Date: Mar. 8, 2007

(87) PCT Pub. No.: WO2006/030095

PCT Pub. Date: Mar. 23, 2006

(65) Prior Publication Data

US 2008/0031675 A1 Feb. 7, 2008

(30) Foreign Application Priority Data

Sep. 8, 2004 (FR) ..... 04 09518

(51) Int. Cl.
*A46B 5/02* (2006.01)

(52) U.S. Cl. ..... 401/6; 16/430

(58) Field of Classification Search ..... 401/6, 401/129, 209; 16/430
See application file for complete search history.

(56) References Cited

U.S. PATENT DOCUMENTS

| | | | | |
|---|---|---|---|---|
| 5,971,644 | A | 10/1999 | Kageyama et al. | |
| 5,988,908 | A | 11/1999 | Kageyama et al. | |
| 5,997,200 | A | 12/1999 | Kageyama et al. | |
| 6,146,038 | A * | 11/2000 | Mittersinker et al. | 401/6 |
| 6,158,910 | A * | 12/2000 | Jolly et al. | 401/6 |
| 6,206,595 | B1 * | 3/2001 | Keda | 401/6 |
| 6,273,626 | B1 * | 8/2001 | Yazawa | 401/6 |
| 6,375,373 | B2 * | 4/2002 | Izushima | 401/6 |
| 6,379,065 | B2 * | 4/2002 | Perry et al. | 401/6 |
| 6,705,789 | B2 * | 3/2004 | Maruyama et al. | 401/93 |
| 2001/0002961 | A1 * | 6/2001 | Izushima | 401/6 |
| 2004/0190973 | A1 | 9/2004 | Nakayama et al. | |

FOREIGN PATENT DOCUMENTS

| | | |
|---|---|---|
| DE | 296 03 705 U1 | 2/1996 |
| DE | 298 05 183 U | 3/1996 |
| DE | 102 848 | 8/2003 |
| JP | 8-207484 | 8/1996 |
| JP | 11 334 272 | 12/1999 |
| JP | 2005 131 968 | 5/2005 |

* cited by examiner

*Primary Examiner*—David J Walczak
(74) *Attorney, Agent, or Firm*—Jones Day

(57) ABSTRACT

A writing instrument that includes a body extending along a central axis between a front end provided with a writing tip and a rear end, the body presenting a grip zone and comprising at least first and second elements that are assembled together, and a tubular grip sleeve covering the grip zone at least in part. The grip sleeve presents at least one projection extending towards the central axis, and the first and second body elements define a housing adapted to receive the projection of the sleeve, the projection being pinched in the housing by the first and second assembled-together elements.

14 Claims, 1 Drawing Sheet

WRITING INSTRUMENT

This application is a national stage application of PCT/EP2005/002203, filed on Sep. 5, 2005.

FIELD OF THE INVENTION

The embodiments of the present invention relate to a writing instrument, and more particularly to a writing instrument comprising:

a body extending along a central axis between a front end provided with a writing tip and a rear end, the body presenting a grip zone and comprising at least first and second elements that are assembled together; and a tubular grip sleeve covering the grip zone at least in part.

BACKGROUND OF THE INVENTION

It is known to cover the grip zone of writing instruments in a sleeve, generally made of a flexible plastics material, in order to improve writing comfort for the user. Nevertheless, certain difficulties arise in fitting and securing such a sleeve on the body of the writing instrument, which is generally made of a material that is different from that of the grip sleeve, such as a hard plastics material or metal, for example.

By way of example, in order to prevent the grip sleeve from moving longitudinally on the body, an annular setback is formed in the grip zone of the body and the tubular sleeve is received therein at least in part. However, it is generally necessary to provide a sleeve of elastic material of diameter that is slightly smaller than that of the annular setback so that the sleeve clamps onto the setback with a certain amount of force and so that the grip sleeve does not become removed in normal use.

This makes it more difficult to put the sleeve into place, in particular when assembly is performed automatically and the sleeve needs to be slid along the body over portions that present an outside diameter that is significantly greater than the diameter of the annular setback.

Furthermore, it is often preferable to prevent the sleeve from turning relative to the body, in particular in order to make the writing instrument feel more comfortable in the hand. For this purpose, provision is generally made to form projecting or indented portions in relief extending longitudinally along the annular setback of the body, with complementary portions in relief on the inside wall of the grip sleeve, so that cooperation between these portions in relief prevents the sleeve from turning. Nevertheless, the presence of such portions in relief complicates fabrication of the body and of the sleeve, and in general it is necessary to make provision for the sleeve to clamp onto the body quite firmly in order to ensure the portions in relief cooperate well. Document U.S. Pat. No. 5,971,644 describes means of that type for holding a grip sleeve stationary.

Certain grip sleeves are secured to the body during molding of those two parts in a mold using a dual-injection technique. Nevertheless, that molding technique is not easy to implement and generally significantly increases the cost of manufacture.

SUMMARY OF THE INVENTION

An object of an embodiment of the present invention is to improve the fitting and securing of grip sleeves on the bodies of writing instruments.

To this end, the embodiments of the present invention provide a writing instrument of the above-specified type, characterized in that the grip sleeve presents at least one projection extending towards the central axis, and in that the first and second body elements define a housing adapted to receive the projection of the sleeve, the projection being pinched in the housing by the first and second assembled-together elements.

By pinching the projection of the grip sleeve between two elements of the writing instrument during assembly thereof, it is possible to hold the sleeve stationary both in translation along the central axis and in rotation about the axis. In addition, by providing for a pinching force that is sufficiently high, it becomes very difficult to remove the grip sleeve without disassembling the first and second body elements. It should be observed that there is no need for the grip sleeve to clamp tightly around the body, but that it may be preferable to provide a certain amount of resilient clamping so that the sleeve remains well pressed against the body.

In preferred embodiments of the present invention, recourse is also had to one or more of the following dispositions:

the first and second elements are tubular and form consecutive longitudinal sections of the body, between which the projection of the sleeve is pinched in a direction parallel to the central axis;

the first element presents an annular longitudinal end face, and the second element presents a radial annular face in its outside wall that is arranged facing the end face of the first element, and a tubular portion extending from the annular face and adapted to be engaged in the first element;

the first element presents a first peripheral face from which it presents an outside wall that is substantially cylindrical up to an end situated beside the second element, and the second element presents a second peripheral face from which it presents an outside portion that is substantially cylindrical extending towards the first element and presenting a diameter substantially equal to the diameter of the outside cylindrical portion of the first element, the first and second faces defining an annular setback in the body in which the grip sleeve is arranged;

one of the first and second elements presents at least one projecting member, and the other of the elements presents a recessed member adapted to cooperate with the projecting member, the first and second elements being assembled by screw fastening their respective members together, thereby ensuring that the projection of the sleeve is pinched with a force that is accurately determined by the distance between the first and second elements on screw fastening, and in addition these two elements can be assembled together in practically inseparable manner;

one of the first and second elements presents a tapped portion extending along the central axis, and the other of the elements presents a threaded portion complementary to the tapped portion, the first and second elements being assembled together by screw fastening, with the projection of the grip sleeve being pinched between the first and second elements, thereby blocking the screw fastening and possibly avoiding untimely unscrewing by virtue of its elasticity;

the first element includes an abutment adapted to engage the second element and limit the extent to which the second element can be engaged in the first element, so as to limit the force with which the sleeve is pinched;

the grip sleeve is made of plastics material that is flexible and elastic, and preferably of elastomer;

the projection of the grip sleeve is arranged longitudinally between the first third and the second third thereof;

the projection of the sleeve is a continuous annular wall extending in a plane perpendicular to the central axis, thereby making molding easier; and the grip zone of the body presents a first window, and the grip sleeve presents a second window arranged in register with the first window, the first and second windows having a movable control member passing therethrough for acting on a pencil lead propelling mechanism arranged inside the body.

BRIEF DESCRIPTION OF THE DRAWINGS

Other characteristics and advantages of the embodiments of the present invention appear from the following description given by way of a non-limiting example and with reference to the accompanying drawing, in which.

DETAILED DESCRIPTION OF THE DRAWINGS

In the various figures, identical references are used to designate elements that are identical or similar.

Figure 1:
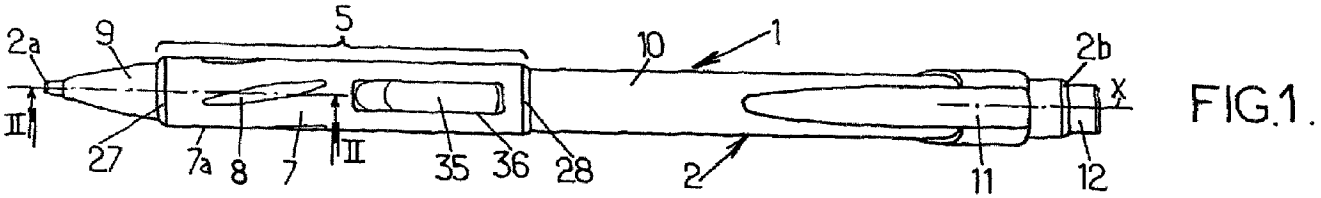
FIG. 1 is a side view of a writing instrument of the present invention, including a grip sleeve.

FIG. 1 shows a writing instrument 1 presenting a body 2 that extends longitudinally along a central axis X between a front end 2*a* and a rear end 2*b*. In the embodiment shown, the writing instrument is a propelling pencil including, inside the body 2, a lead-propelling mechanism (not shown) that enables pencil leads to be advanced through an opening 3 situated at the front end 2*a* of the body. Nevertheless, the embodiments of the present invention are applicable to all types of writing instruments having a grip zone, such as, for example, ball-point or felt-tip pens, and regardless of whether the point or tip is mounted stationary at the front end 2*a* or whether it is retractable into the body.

The body 2 presents a grip zone 5 whereby the instrument is held naturally while the user is writing. The grip zone 5 extends from the base of the conical portion forming the front nose 9 of the body towards the rear end 2*b* over about one-third of the length of the writing instrument. Nevertheless, depending on the dimensions and the shape of the instrument, the grip zone 5 may cover a zone that is significantly different, but it must cover at least the portion held by the user while writing.

The grip zone 5 is covered by a grip sleeve 7 presenting an outside surface 7*a* that is generally cylindrical with shallow embossing 8 in the embodiment shown. Naturally, the outside surface 7*a* of the sleeve could present a shape that is more complex with an outside diameter that varies significantly or with projecting or indented embossing 8 that is more marked.

The sleeve 7 is made of plastics material that is flexible, i.e. that can be deformed relatively easily, and that is elastic so as to return to its initial configuration after it has been deformed and so as to exert a certain amount of clamping force on the body 2, as explained below. By way of example it may comprise an elastomer containing silicone.

The body 2 is made up of two elements, a first element 9 forming the front nose and a second element 10 forming the shank that extends from the nose 9 to the rear end 2*b* of the body. The nose 9 and the shank 10 thus constitute two consecutive longitudinal sections of the body. The body 2 could be made up of more than two elements, and naturally the terms "first" and "second" elements for designating respectively the nose 9 and the shank 10, could be inverted or could be applied to elements that do not extend all the way to an end of the body.

The body 2 has mounted thereon a clip 11 presenting an annular base engaged on the shank 10, and an eraser 12 mounted in a housing at the rear end 2*b*.

The nose 9 and the body 10 are tubular parts defining a hollow inside space in which there are arranged a lead holder and a lead-propelling mechanism of known type and not shown in the figure. However, depending on the type of writing instrument to which the invention is applied, the space inside the body 2 could naturally contain an ink reservoir and/or a mechanism for extending/retracting a writing tip.

Figure 2:
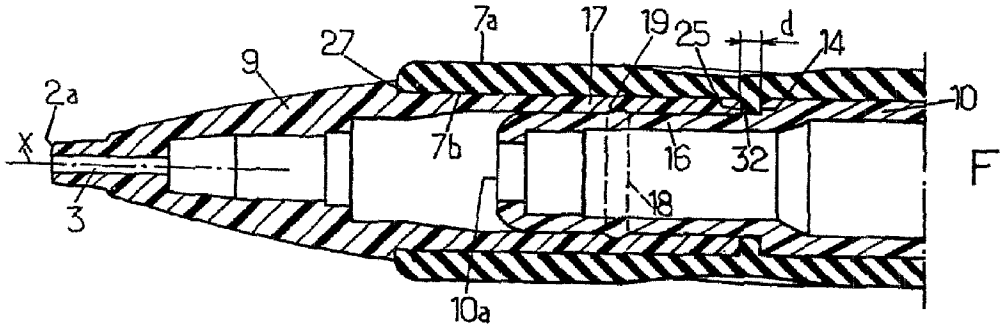
FIG. 2 is a simplified section view on line II-II of FIG. 1.
Figure 4:
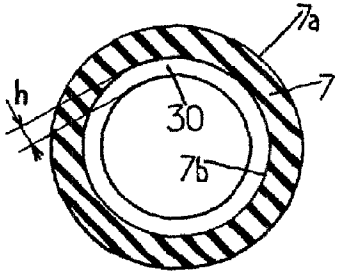
FIG. 4 is a section view on line IV-IV of the grip sleeve shown in FIG. 3.
Figure 3:
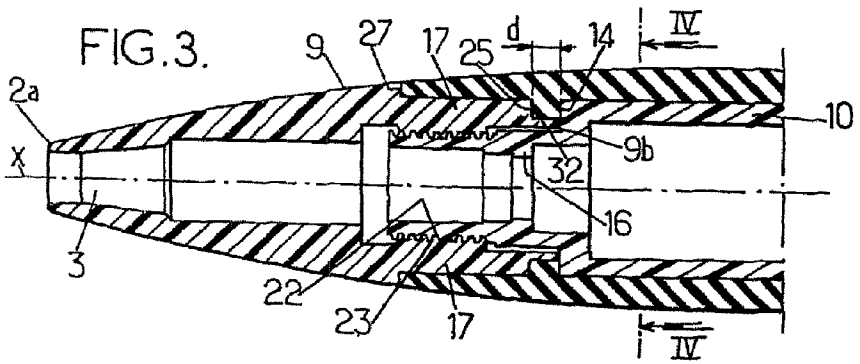
FIG. 3 is a view analogous to FIG. 2 showing another embodiment.

The nose 9 and the shank 10 are assembled together to form the body 2 of the pen, and this can be done in two different ways corresponding to each of the embodiments shown in FIGS. 2 and 3.

In the embodiment shown in FIG. 2, the nose 9 and the shank 10 are assembled together by snap fastening. The shank 10 presents a radial annular face 14 in its outside wall from which a portion 16 of smaller diameter extends to the front end 10*a* of the shank. The portion 16 of the shank presents an outside wall adapted to be inserted as a snug fit in the rear portion 17 of the nose 9. On its outside surface, the portion 16 of the shank includes a projecting portion in relief 18 that, in the embodiment shown, is in the form of a peripheral bead. The inside wall of the portion 17 of the nose 9 presents a recessed portion in relief 19 complementary to the bead 18 and into which the bead 18 snaps when the shank 10 is pushed into the nose 9 over a determined length. The mutual engagement of the portions in relief 18 and 19 prevents the shank 10 from moving back relative to the nose 9 towards the rear end 2*b*. In the embodiment shown, the cooperation between the portions in relief 18 and 19 also prevents the shank 10 from moving forwards relative to the nose 9 towards the front end 2*a* of the body, and consequently limits the extent to which the shank 10 can be engaged in the nose 9. Nevertheless, prevention of forward movement is not absolutely essential. The snap fastening portions in relief 18 and 19 could be of significantly different shape. For example, the relief on the portion 16 of the shank could be in the form of studs, possibly mounted on resilient tabs, each presenting a face looking towards the front end 2*a* that is inclined relative to the central axis X, and a radial face looking towards the rear end 2*b* that engages with the rear end of a window formed in the portion 17 of the nose 9. The force required to snap fasten the nose 9 with the shank 10 is preferably sufficiently strong to prevent manual disassembly by the user.

In the embodiment shown in FIG. 3, the nose 9 and the shank 10 are assembled by screw fastening. For this purpose, the portion 16 of the shank presents a thread 22 on its radially outer face, and the portion 17 of the nose 9 includes tapping 23 on its radially inner face, and complementary to the thread 22.

It should be observed that the nose 9 presents a rear end 9*b* that forms an abutment coming against the radial face 14 of the shank 10, such that even in the absence of the grip sleeve 7, the extent to which the shank 10 can be engaged in the nose 9 by screw fastening is limited to a determined depth.

The nose 9 presents an annular face 25 extending radially relative to the central axis X and arranged to face the annular face 14 of the shank 10. In the embodiment shown in figure, the annular face 25 is formed by the end face of the nose 9 looking towards the rear end 2*b* of the body. In the embodiment shown in FIG. 3, the annular face 25 is formed by a radial face situated at a determined distance from the rear end 9*b* of the nose.

Because the portion 16 of the shank 10 is engaged in the portion 17 of the nose 9 over a determined depth, the annular face 25 of the nose 9 is spaced apart from the face 14 of the shank by a determined distance "d" as measured along the central axis X when the elements 9 and 10 are assembled together.

Furthermore, the nose 9 includes a radial face 27 that extends around the entire periphery of the nose 9, such that the portion 17 thereof presents a reduced outside diameter. In analogous manner, the shank 10 presents a radial face 28 that extends around the periphery of the shank, such that the portion of the shank extending between the face 28 and the face 27 presents an outside diameter that is smaller than the outside diameter of the portion of the shank that extends towards the rear end 2*b* from the face 28. The diameter of this portion is substantially equal to the outside diameter of the portion 17 so that the cylindrical outside face of the portion extends in register with the cylindrical outside face of the portion 17.

The faces 27 and 28 thus define an annular setback extending over the entire periphery of the assembled body 2 and covering the grip zone 5.

The grip sleeve 7 presents a cylindrical radially inner surface 7*b* of diameter slightly smaller than the outside diameter of the annular setback defined by the faces 27 and 28, so that the sleeve 7 clamps elastically onto the setback. Nevertheless, it should be observed that this clamping of the sleeve is solely for the purpose of holding the sleeve firmly in the setback of the shank, and that this clamping force is considerably less than the clamping force exerted by grip sleeves in the prior art where the clamping force is intended on its own to prevent such a sleeve from moving.

The sleeve 7 includes a projection 30 that extends radially towards the central axis X from its inside face 7*b* over a distance "h" that is measured radially. The projection 30 presents a determined thickness as measured along the central axis X. The projection 30 is formed integrally with the sleeve 7 and is in the form of a continuous circular ring, i.e. it presents a cross-section that is rectangular and constant. The projection 30 is arranged longitudinally in such a manner as to be positioned in the housing 32 of the body 2 as defined by the annular face 14 of the shank 10 and the annular face 25 of the nose 9, the radial extent of these annular faces 14 and 25 being not less than the height "h" of the projection 30.

The thickness of the projection 30 is not less than, and is preferably a few tenths of a millimeter greater than, the distance "d" between the annular faces 14 and 25 of the housing 32 when the body 2 is assembled, thereby causing the projection 30 of the sleeve 7 to be pinched between the nose 9 and the shank 10, and consequently applying compression along the central axis X on the projection 30.

Thus, by means of the projection 30, the grip sleeve 7 is completely prevented from moving relative to the body 2, whether in translation along the central axis X or in a radial direction, or in rotation about the central axis X.

The projection 30 is arranged in a substantially middle portion of the sleeve, i.e. between the first third and the second third along the length of the sleeve, so as to limit possibilities for the sleeve twisting or becoming partially separated.

The continuous annular shape of the projection 30 of the sleeve in combination with the cylindrical inside face 7*b* makes the sleeve 7 easy to mold. Nevertheless, it is entirely possible to envisage providing a projection 30 that does not extend over the entire inside periphery of the sleeve 7, or to provide a variety of projections that are spaced apart longitudinally or angularly over the inside surface 7*b* of the sleeve. Naturally, the elements 9 and 10 making up the body 2 can define one or more housings adapted to receive these projections of the sleeve, and could optionally include an additional element in the event of there being a plurality of projections spaced apart longitudinally along the central axis. It should be observed that the projections are not necessarily compressed along the central axis X, but that they could be compressed by faces of the elements making up the body 2 that extend in planes that are inclined relative to a plane transverse relative to the central axis X, which faces could be parallel or non-parallel.

Preventing the sleeve 7 from turning by means of the projection 30 being pinched is particularly useful for a writing instrument 1 that includes a side control button 35 situated in the grip zone 5. More particularly, in the embodiment shown, the side button 35 controls a pincer mechanism for propelling the lead and that can be actuated by the user without moving the fingers from the writing position. The shank 10 then presents a window (not shown) through which the button 35 is mounted to move in radial translation or in tilting. The sleeve 7 presents a window 36 arranged to be brought into register with the window in the shank 10, and through which the button 35 is movably mounted. The window 36 preferably presents dimensions to avoid coming into contact with the button 35 while it is moving. Because the sleeve 7 is prevented from moving in rotation relative to the shank 10, there is no risk of one of the edges of the window 37 coming to bear against the button 35 and thus interfere with propelling the lead.

It is also possible to provide a portion in relief on the sleeve 7 for keying purposes, e.g. on the projection 30 or on one of the longitudinal end faces thereof, with a corresponding recess being provided for keying purposes in an element of the body 2, in particular in the shank 10, so as to guarantee that the sleeve 7 is at the correct angular orientation relative to the shank 10, and so as to ensure that the windows of these two parts are brought into register during assembly.

In order to assemble the body 2 and the grip sleeve 7 together, the procedure is as follows. The sleeve 7 is engaged on the shank 10 over its front end 10*a*, with this being relatively easy because of the relatively small clamping force exerted by the sleeve 7 on the outside wall of the shank. Once the sleeve 7 is correctly positioned on the shank 10, i.e. when the projection 30 of the sleeve comes to bear against the face 14 of the shank, and possibly when a keying portion in relief on the sleeve comes into register with a keying recess in the shank, the portion 17 of the nose 9 is inserted into the sleeve 7 via its front end.

In the embodiment shown in FIG. 2, this insertion is performed by moving in translation only along the axis X until the nose 9 snap fastens with the shank 10 when the portions in relief 18 and 19 cooperate, thereby pinching the projection 30 of the sleeve with a determined force.

In the embodiment shown in FIG. 3, insertion of the nose 9 into the sleeve 7 is continued by screwing the tapped portion 23 of the nose onto the threaded portion 22 of the shank until the rear end 9*b* of the nose comes into abutment against the radial face 14 of the shank, thereby pinching the projection 30 of the sleeve with a determined force. It should be observed that in this embodiment, the compression force exerted by the elastic material of the projection 30 against the annular face 25 of the nose 9 and possibly the bottom of the housing 32 defined by the nose 9 serves to limit any risk of the nose 9 becoming unscrewed in untimely manner.

Naturally, the embodiments of the present invention described above are not limiting in any way. As can be seen from the above description, the shape of the projection(s) of the sleeve, and the structure of the corresponding housing(s) formed by the body elements of the writing instrument could be significantly different. Furthermore, the body elements could be assembled other than by snap fastening or screw fastening, for example they could be bonded together by heat-sealing.

The invention claimed is:

1. A writing instrument comprising:

a body extending along a central axis between a front end provided with a writing tip and a rear end, the body including a grip zone and comprising at least first and second elements that are assembled together; and a tubular grip sleeve covering the grip zone at least in part, wherein the grip sleeve includes at least one projection extending towards the central axis, and wherein the first and second body elements define a housing adapted to receive the projection of the sleeve, the projection being pinched in the housing by the first and second assembled-together elements in a direction parallel to the central axis, and wherein said first and second body elements are designed to enable separation and reassembly after initial assembly.

2. The writing instrument according to claim 1, wherein the first and second elements are tubular and form consecutive longitudinal sections of the body, between which the projection of the sleeve is pinched.

3. The writing instrument according to claim 2, wherein the first element includes an annular radial end face, and wherein the second element includes a radial annular face in its outside wall that is arranged facing the end face of the first element, and a tubular portion extending from the annular face and adapted to be engaged in the first element.

4. The writing instrument according to claim 3, wherein the first element includes a first radial face from which it includes an outside wall that is substantially cylindrical up to an end situated beside the second element, and wherein the second element includes a second radial face from which it includes an outside portion that is substantially cylindrical extending towards the first element and including a diameter substantially equal to the diameter of the outside cylindrical portion of the first element, the first and second radial faces defining an annular setback in the body wherein the sleeve is arranged.

5. The writing instrument according to claim 4, wherein at least one of the first and second elements includes at least one projecting member and wherein the other of the elements includes a recessed member adapted to cooperate with the projecting member, the first and second elements being assembled by screw fastening their respective members together.

6. The writing instrument according to claim 4, wherein at least one of the first and second elements includes a tapped portion extending along the central axis, and the other of the elements includes a threaded portion complementary to the tapped portion, the first and second elements being assembled together by screw fastening.

7. The writing instrument according to claim 4, wherein the first element includes an abutment adapted to come up against the second element and limit engagement of the second element in the first element.

8. The writing instrument according to claim 1, wherein the grip sleeve is made of plastics material that is flexible and elastic such as an elastomer.

9. The writing instrument according to claim 1, wherein the projection of the grip sleeve is arranged longitudinally between the first third and the second third thereof.

10. The writing instrument according to claim 1, wherein the projection of the sleeve is a continuous annular wall extending in a plane perpendicular to the central axis.

11. The writing instrument according to claim 1, wherein the grip zone of the body includes a first window, and wherein the grip sleeve includes a second window arranged in register with the first window, the first and second windows having a movable control member passing there-through for acting on a pencil lead propelling mechanism arranged inside the body.

12. A writing instrument comprising:

a body extending along a central axis between a front end provided with a writing tip and a rear end, the body including a grip zone and comprising at least first and second elements that are assembled together; and a tubular grip sleeve covering the grip zone at least in part, wherein the grip sleeve includes at least one projection extending towards the central axis, wherein the first and second body elements define a housing adapted to receive the projection of the sleeve, the projection being pinched in the housing by the first and second assembled-together elements, wherein the first and second elements are tubular and form consecutive longitudinal sections of the body, between which the projection of the sleeve is pinched in a direction parallel to the central axis, wherein said first and second body elements are designed to enable separation and reassembly after initial assembly, and wherein the first element includes an annular radial end face, and wherein the second element includes a radial annular face in its outside wall that is arranged facing the end face of the first element, and a tubular portion extending from the annular face and adapted to be engaged in the first element.

13. A writing instrument comprising:

a body extending along a central axis between a front end provided with a writing tip and a rear end, the body including a grip zone and comprising at least first and second elements that are assembled together; and a tubular grip sleeve covering the grip zone at least in part, wherein the grip sleeve includes at least one projection extending towards the central axis, wherein the first and second body elements define a housing adapted to receive the projection of the sleeve, the projection being pinched in the housing by the first and second assembled-together elements, and wherein the grip zone of the body includes a first window, and wherein the grip sleeve includes a second window arranged in register with the first window, the first and second windows having a movable control member passing there-through for acting on a pencil lead propelling mechanism arranged inside the body.

14. A writing instrument comprising:

a body extending along a central axis between a front end provided with a writing tip and a rear end, the body including a grip zone and comprising at least first and second elements that are assembled together; and a tubular grip sleeve covering the grip zone at least in part, wherein the grip sleeve includes at least one projection extending towards the central axis, wherein the first and second body elements define a housing adapted to receive the projection of the sleeve, the projection being pinched in the housing by the first and second assembled-together elements in a direction parallel to the central axis, wherein said first and second body elements are assembled together in a separable manner, and wherein the projection of the grip sleeve is arranged longitudinally between the first third and the second third thereof.

* * * * *